US005415725A

United States Patent [19]

Scharf

[11] Patent Number: 5,415,725

[45] Date of Patent: May 16, 1995

[54] DEVICE FOR REMOVING GLUED DOWN CARPET

[76] Inventor: Gary Scharf, 9825 Carrol Center Rd., #200, San Diego, Calif. 92126

[21] Appl. No.: 269,783

[22] Filed: Jul. 1, 1994

[51] Int. Cl.[6] ..... B32B 35/00

[52] U.S. Cl. ..... 156/584; 156/250; 156/344; 156/523; 30/273; 83/167; 226/176; 299/37

[58] Field of Search ..... 156/247, 344, 543, 584, 156/250, 523; 15/93.1; 30/169, 170, 272.1, 273; 83/167; 299/37; 226/12, 91, 176

[56] References Cited

U.S. PATENT DOCUMENTS

| | | | |
|---|---|---|---|
| 3,350,256 | 10/1967 | Eckman et al. | 156/523 X |
| 4,362,187 | 12/1982 | Harris et al. | 227/207 A X |
| 4,368,837 | 1/1983 | Bodewein | 226/176 |
| 4,790,125 | 12/1988 | Merritt, III | 226/176 X |
| 4,948,451 | 8/1990 | Foltz | 156/584 X |

FOREIGN PATENT DOCUMENTS

| | | | |
|---|---|---|---|
| WO92/03290 | 3/1992 | WIPO | 156/344 |

*Primary Examiner*—Mark A. Osele

*Attorney, Agent, or Firm*—Charles C. Logan, II

[57] ABSTRACT

Apparatus for removing glued-down carpet and it has a frame having a pair of laterally spaced side walls connected together by a plurality of cross members. A motor that is connected to a gear box is mounted on one of the cross members. The frame is mounted on a pair of rear wheels. A pair of drive rollers, have their opposite ends journaled in said respective side walls. A pressure roller extends between the side walls and it is spaced a predetermined vertical distance below said drive rollers. The pressure roller is journaled between a pair of leverage arms that are pivotally mounted on said side walls. A handle is connected to the top end of said leverage arms. A tab portion of glued-down carpet to be removed is threaded over the pressure roller and under the drive rollers. A downward pressure on the handle causes the leverage arms to pivot the pressure roller upwardly toward the drive rollers. Once the tab portion of the carpet is securely wedged between the pressure roller and the drive rollers, the motor is started and this causes the drive motor to pull the carpet up from the floor as the apparatus travels along the top of the carpet.

7 Claims, 2 Drawing Sheets

DEVICE FOR REMOVING GLUED DOWN CARPET

BACKGROUND OF THE INVENTION

The invention relates to a carpet removing device, and more specifically a device for removing carpet that has been glued to a concrete surface or other type of support surface.

There are several situations where carpet is glued to its supporting surface. Some instances are in shopping malls, commercial offices, motels, hotels etc. The glue used is an extremely strong adhesive making it very difficult to remove old carpet for replacement purposes. Normally a crew of several men must pry up small sections of the carpet at a time. This is very hard physical work and expensive to do. The work of prying up the carpet often results in strained back muscles and other physical problems.

It is an object of the invention to provide a novel apparatus for removing glued-down carpet that eliminates the strains that are normally placed upon a person's back and other muscles when trying to pry up the carpet.

It is also an object of the invention to provide a novel apparatus for removing glued-down carpet that allows the removal to be accomplished in a much shorter period of time and at a reduced cost.

It is another object of the invention to provide a novel apparatus for removing glued-down carpet that will literally drive itself across the carpet strip being removed by the motor of the apparatus.

It is an additional object of the invention to provide a novel apparatus for removing glued-down carpet that is economical to manufacture and market.

SUMMARY OF THE INVENTION

The apparatus for removing glued-down carpet has a frame structure formed from a pair of laterally spaced side walls and a plurality of laterally extending support cross members that have their opposite ends connected to the top edges of the side walls. A handle, much in the manner of a lawn mower handle, has its laterally spaced forward ends connected to the top end of a pair of laterally spaced leverage arms that are pivotally secured to the side walls. An electric motor that is connected to a gear box is mounted on the top surface of one of the support cross members. An electrical cord that extends from the drive motor leads to an on/off switch mounted on the top of the rear end of the handle. An electric cord leads from the on/off switch to a plug to be inserted into an electrical wall socket. A pair of wheels are mounted on an axle extending laterally between the respective side walls adjacent their rear end.

Adjacent the front end of the side walls, in a spaced vertical relationship, are mounted a pair of drive rollers that are positioned a predetermined height above a pressure roller. Both the drive rollers and pressure roller have shafts extending outwardly from their opposite ends and these are journaled in bearing assemblies mounted on the inner surface of the respective side walls and on the inner surface of the bottom end of the leverage arms. The shafts of the drive rollers extends through one of the side walls and they have a sprocket gear mounted thereon. A drive shaft also extends from the gearbox and it has a sprocket gear thereon. A chain passes around the respective sprocket gears to transmit the rotational motion of the drive shaft of the electric motor to the drive rollers.

The manner in which the apparatus is used will now be described. First a triangularly shaped tab portion of the glued down carpet is cut and raised by using a giant awl in order to lift the tab portion high enough to expose approximately six inches of material. This tab portion is then threaded over the pressure roller and under the drive rollers. At least one of the drive rollers are coated with an abrasive material on its outer surface. By pressing downwardly on the handle, the leverage arms pivot the pressure roller up towards the drive roller. Once the pressure roller has been actuated sufficiently to provide a positive grip on the tab portion of the carpet, the on/off switch is actuated causing the electric motor to drive the apparatus forwardly. There are a pair of laterally spaced knives supported from the inner surface of the side walls. Thus, as the tab portion of the glued down carpet is being drawn inwardly between the pressure roller and the drive rollers, the laterally spaced knives are cutting the carpet into a strip having a predetermined width W. When the person operating the apparatus approaches the last six inches next to the wall, they shut off the motor and merely pull downwardly on the handle and with its leverage they can lift the last six inches of glued down carpet. Next another strip of carpet is lifted in the same manner and this continues until all the carpet is removed.

DESCRIPTION OF THE PREFERRED EMBODIMENT

Figure 1:
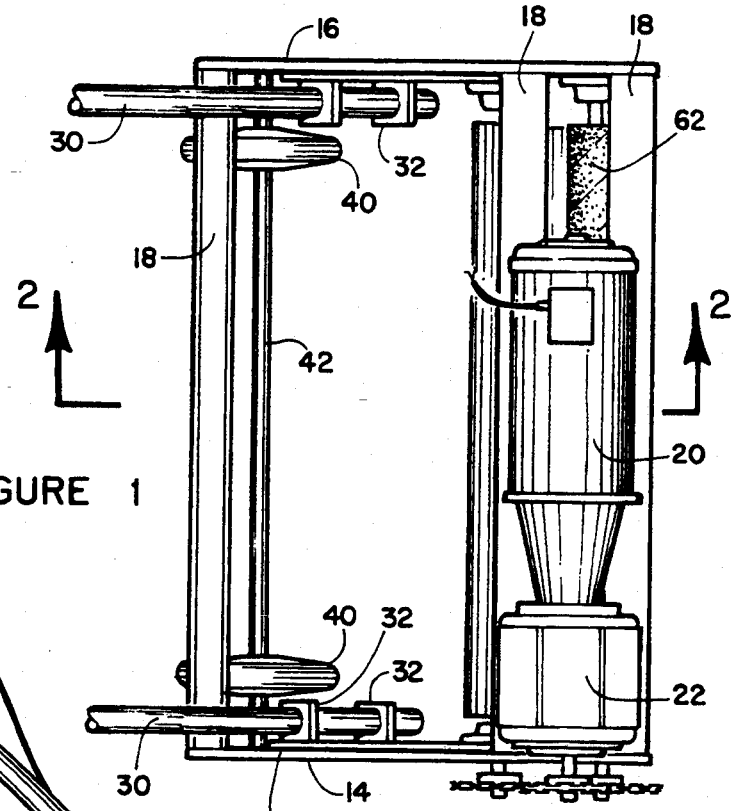
FIG. 1 is a top plan view of the apparatus for removing glued-down carpet.
Figure 2:
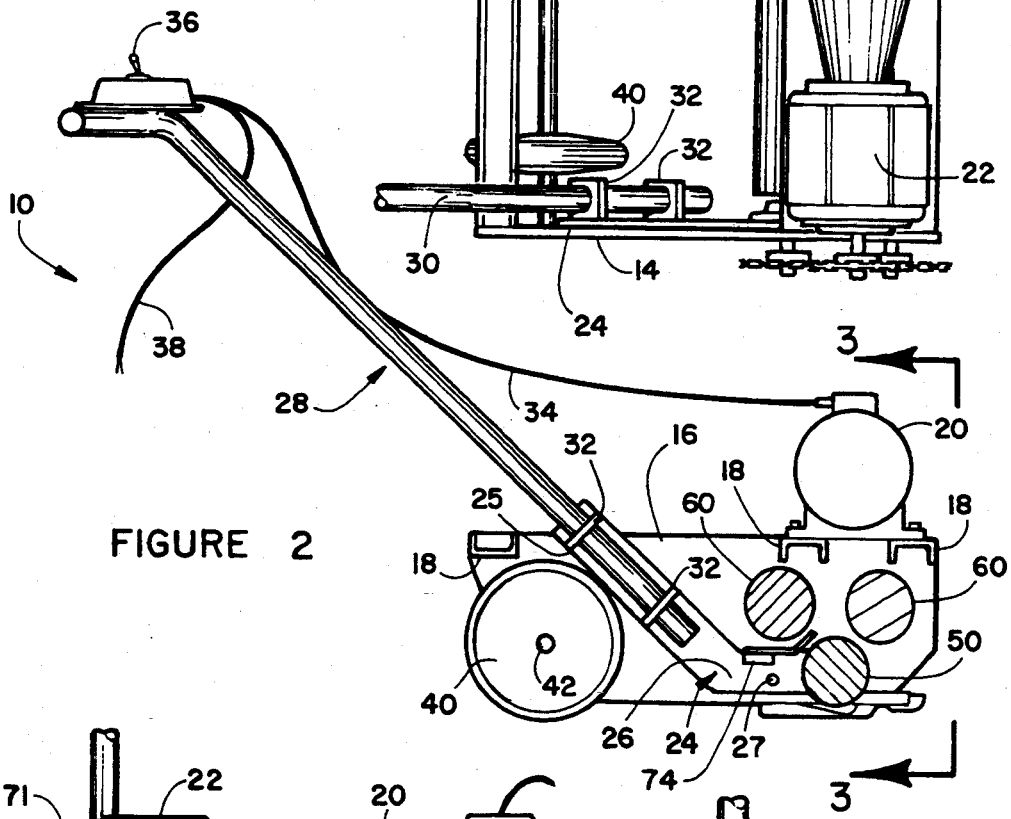
FIG. 2 is a schematic cross sectional view taken along lines 2—2 of FIG. 1.
Figure 3:
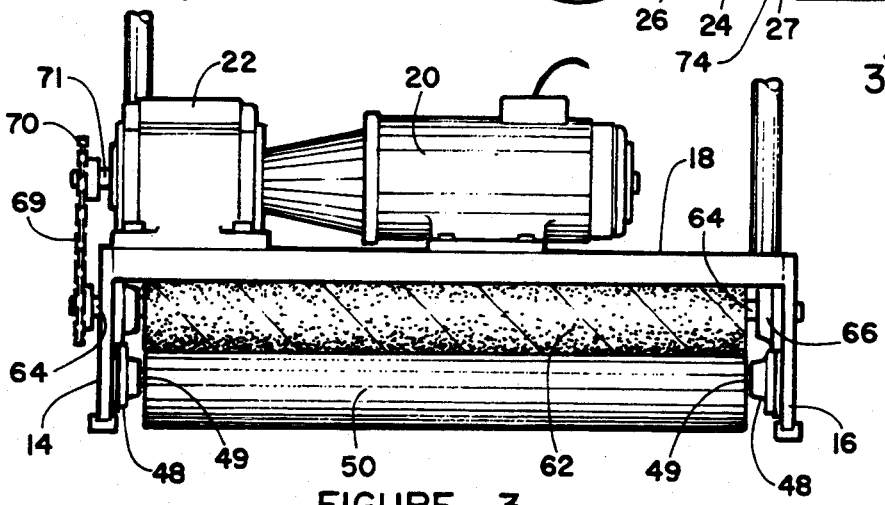
FIG. 3 is a front end elevation view taken along lines 3—3 of FIG. 1.

The apparatus for removing glued-down carpet is generally designated numeral 10 and it will be described by referring to FIGS. 1–6 of the drawings.

Apparatus 10 has a frame formed from a pair of laterally spaced side walls 14 and 16 and a plurality support cross members 18. A motor 20 is connected to gear box 22 and they are mounted on the top surface of a support cross member 18.

A handle 28 has a pair of laterally spaced forward ends 30 that are connected by brackets 32 to leverage arms 24. Leverage arms 24 have leg portions 25 and 26 and leg portions 26 are pivotally mounted on pivot pins 27. An electrical cord 34 has its one end connected to motor 20 and its other end connected to on/off switch 36 that is mounted on the top rear end of handle 28. Electrical cord 38 is plugged in to an electrical power source.

A pair of laterally spaced wheels 40 are mounted on an axle 42 that is supportably connected to the frame.

Pressure roller 50 has a short shaft 49 extending from its opposite ends that are received in the respective bearing blocks 48.

At least one of the drive rollers 60 is covered with an abrasive material 62. Their opposite ends have shafts 64 extending therefrom that are journaled in bearing assemblies 66. One end of the shafts 64 passes through side wall 14 and they have sprocket gears 68 mounted thereon. A chain 69 passes around sprocket gears 68 and sprocket gear 70 that is mounted on a drive shaft 71 extending from gear box 22. Rotation of drive shaft 71 causes drive rollers 60 to rotate.

Figure 4:
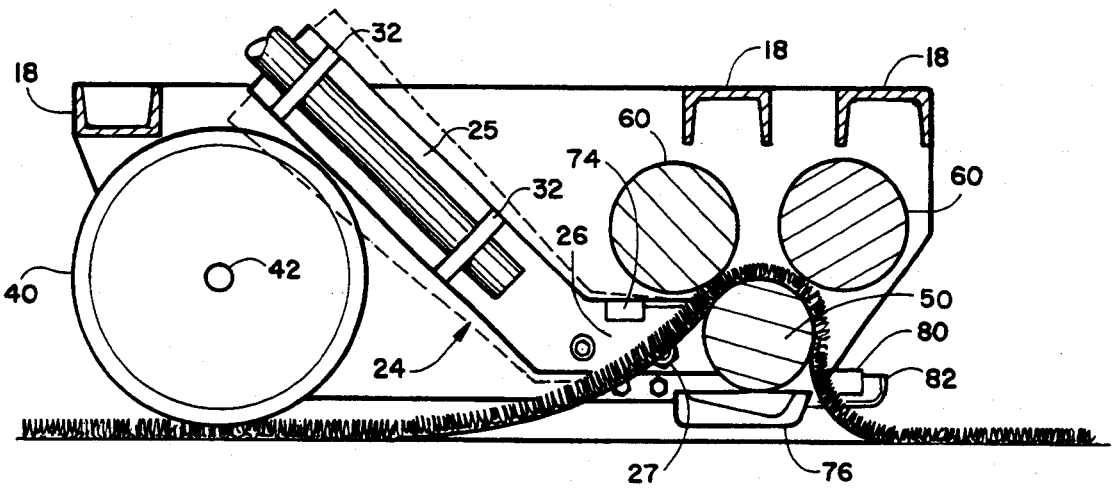
FIG. 4 is an enlarged schematic view showing the manner in which the carpet is lifted and threaded upwardly between the respective rollers of the apparatus.
Figure 6:
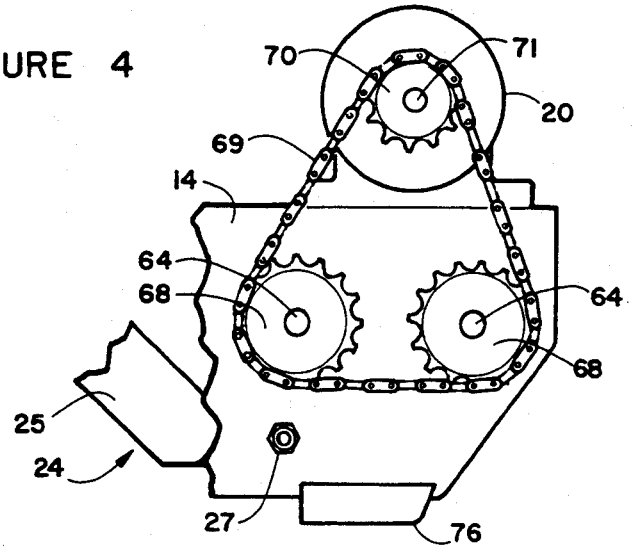
FIG. 6 is a schematic illustration showing how the drive rollers are driven by the motor.

FIG. 4 discloses a knife mechanisms for cutting the carpet as it is drawn into apparatus 10. Brackets 80 have a knife blade 82 that would cause strips of removed carpet having a predetermined width W to be lifted from the floor surface. A pair of laterally spaced wiper blades 74 help lift the strip of carpet off pressure roller 50 and direct it rearwardly. The dot-dash lines show the position of leverage arms 24 as pressure roller 50 travels between its at rest position in support brackets 76 and its upper position that wedges the removed strip of carpet against drive rollers 60.

Figure 5:
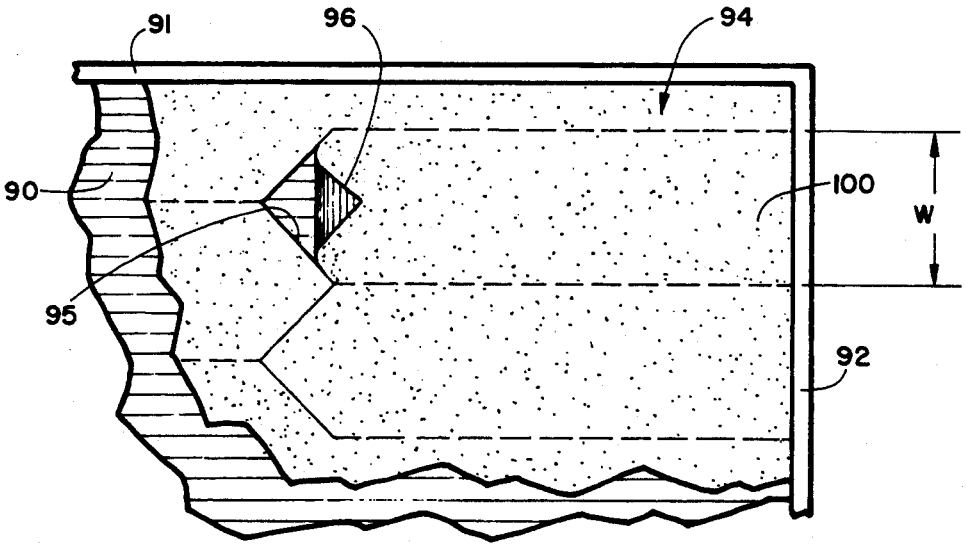
FIG. 5 is a top plan schematic view illustrating the manner in which the strips of glued-down carpet are systematically removed from the floor.

FIG. 5 is a schematic illustration of the manner in which the glued-down carpet would be removed from an area having a floor 90, and walls 91 and 92. The carpet 94 would have an initial cut 95 made in order to provide a triangularly shaped tab portion 96. This tab portion would then be threaded over pressure roller 50 and into the area under drive rollers 60. Next the handle 28 would be pressed downwardly to force pressure roller 50 into positive contact with carpet 94 and the respective drive rollers 60. Next the on/off switch 36 is actuated and apparatus 10 would propel itself across carpet 94 due to the action of drive rollers 60 and it would lift a strip of glued down carpet having a predetermined width W. This same operation would be done over and over until all of the carpet 94 has been removed.

What is claimed is:

1. Apparatus for removing glued-down carpet comprising:

a frame having a pair of laterally spaced side walls that are connected together by a plurality of cross members, said side walls each having a bottom edge, an outer surface and an inner surface, said frame having a front end and a rear end;

a pair of wheels and means for mounting one adjacent each of said side walls;

a pair of laterally spaced drive rollers each mounted on a separate secondary drive shaft whose opposite ends are journaled on said laterally spaced side walls, each of said drive rollers having a longitudinally extending axis and these axes are spaced a predetermined height above the bottom edge of said sidewalls;

an electric motor mounted on one of said cross members, said electric motor being connected to a primary drive shaft;

means for transmitting the rotational motion of said primary drive shaft to said secondary drive shafts;

a pair of laterally spaced leverage arms each having a forwardly extending leg portion and a rearwardly extending leg portion and said leg portions are oriented to each other at an obtuse angle;

means pivotally mounting one of said leverage arms to each of the side walls of said frame;

a transversely extending pressure roller having a longitudinal axis and having each of its opposite ends journaled in the forwardly extending leg portions of said laterally spaced leverage arms, the longitudinal axis of said pressure roller being spaced a predetermined height below the axes of said drive rollers;

a handle having laterally spaced elongated members each having a front end that is connected to one of the respective rearwardly extending leg portions of said leverage arms for pivoting said pressure roller upwardly toward said drive rollers so that when a strip of carpet is threaded therebetween, it can be gripped between said pressure roller and said drive rollers to drive it through said apparatus.

2. Apparatus for removing glued-down carpet as recited in claim 1 wherein one of said drive rollers is coated with an abrasive material.

3. Apparatus for removing glued-down carpet as recited in claim 1 further comprising an electrical cord connected to said electric motor.

4. Apparatus for removing glued-down carpet as recited in claim 3 further comprising an on-off switch mounted on said handle and it is connected to said electrical cord.

5. Apparatus for removing glued-down carpet as recited in claim 1 wherein said means for transmitting the rotational motion of said primary drive shaft to said secondary drive shafts comprises a sprocket gear mounted on said primary drive shaft, a sprocket gear mounted on each said secondary drive shaft and a chain passing around said respective sprocket gears.

6. Apparatus for removing glued-down carpet as recited in claim 1 further comprising means for cutting a strip of carpet into a predetermined width prior to its being drawn between said drive roller and said pressure roller.

7. Apparatus for removing glued-down carpet as recited in claim 6 wherein said means for cutting a strip of carpet into a predetermined width comprises a pair of laterally spaced brackets with a knife blade mounted on each bracket and said knife blades are mounted forwardly of said pressure roller.

* * * * *